United States Patent [19]

Williams

[11] Patent Number: 4,611,436

[45] Date of Patent: Sep. 16, 1986

[54] SLIDING DOOR ASSEMBLY

[75] Inventor: Harold L. Williams, Union City, Tenn.

[73] Assignee: Southern Door Company, Union City, Tenn.

[21] Appl. No.: 745,800

[22] Filed: Jun. 17, 1985

[51] Int. Cl.[4] ..... E05D 15/06

[52] U.S. Cl. ..... 49/425; 4/557; 4/607; 4/610

[58] Field of Search ..... 49/425, 404; 4/607, 4/610, 557

[56] References Cited

U.S. PATENT DOCUMENTS 2,911,654 11/1959 Bruno ..... 4/607

4,258,443 3/1984 Baus ..... 4/607 X

*Primary Examiner*—Philip C. Kannan

*Attorney, Agent, or Firm*—Walker & McKenzie

[57] ABSTRACT

A sliding door assembly for bathtubs, shower stalls and the like. The assembly includes at least one door panel, an elongated support rail member, and support mount structure for slidably mounting the door panel to the support rail member. The support mount structure includes an elongated carriage member attached to the door panel and a pair of support rollers mounted to the carriage member and engaging the support rail member. The rollers are free to move lengthwise along the carriage member as the door is open and closed. However, structure is provided to stop the lengthwise motion of the rollers just prior to the door panel reaching a closed position to brake the motion of the door panel as it is moved to the closed position.

8 Claims, 13 Drawing Figures

SLIDING DOOR ASSEMBLY

BACKGROUND OF THE INVENTION

1. Field of the Invention

The present invention relates, in general, to sliding door assemblies such as used to selectively enclose a shower stall or bathtub.

2. Description of the Prior Art

Many means have heretofore been developed for selectively enclosing shower stalls and bathtubs including, for example, the typical waterproof curtain slidably hung by way of a rod or the like. A preliminary patentability search in Class 4, subclasses 599, 607, 610 and 614 disclosed the following patents: Lehman, U.S. Pat. No. 1,944,440; Zechiel, U.S. Pat. No. 2,331,822; Jacobson, U.S. Pat. No. 2,748,908; Merrill, U.S. Pat. No. 2,885,000; Bruno, U.S. Pat. No. 2,911,654; Conroy, U.S. Pat. No. 3,021,576; Kochanowski, U.S. Pat. No. 3,037,555; Taubman, U.S. Pat. No. 3,074,077; Kochanowski, U.S. Pat. No, 3,102,581; Grossman, U.S. Pat. No. 3,111,208; Casebolt, U.S. Pat. No. 3,359,573; Baus, U.S. Pat. No. 4,090,265; and Jacobsen, U.S. Pat. No. 4,358,863. None of the above patents disclose or suggest the present invention.

SUMMARY OF THE INVENTION

The present invention is directed toward providing an improved sliding door assembly. One objective of the present invention is to rollably support a door panel in such a manner to brake the motion of the door panel as the door panel is moved to a closed position. Another objective of the present invention is to rollably support a slidable door panel from the bottom edge thereof. Another objective of the present invention is to provide a sliding door assembly in which the support structure thereof is constructed entirely out of plastic. Another objective of the present invention is to provide a sliding door assembly that does not trap water in the support structure thereof.

The sliding door assembly of the present invention includes, in general, a door panel having at least one horizontal edge; an elongated support rail member attached to support structure in a substantially horizontal position; and support mount means attached to the door panel for slidably mounting the door panel to the support rail member and for allowing the door panel to move between open and closed positions. The support mount means includes an elongated carriage member fixedly attached to the at least one horizontal edge of the door panel and includes a pair of support rollers mounted to the carriage member and engaging the support rail member. The carriage member has a first end and a second end and has an elongated slot therein extending between the first and second ends for receiving the support rollers. Each of the support rollers includes a roller body for engaging the support rail member and an axle means for engaging the carriage member. The slot in the carriage member has an elongated channel means for receiving the axle means and for allowing the support rollers to move lengthwise along the slot as the door panel is moved between the opened and closed positions. The carriage member may include a stop means for stopping the lengthwise movement of the support rollers within the slot just prior to the door panel reaching the closed position to brake the motion of the door panel as the door panel is moved to the closed position.

DESCRIPTION OF THE PREFERRED EMBODIMENT

Figure 1:
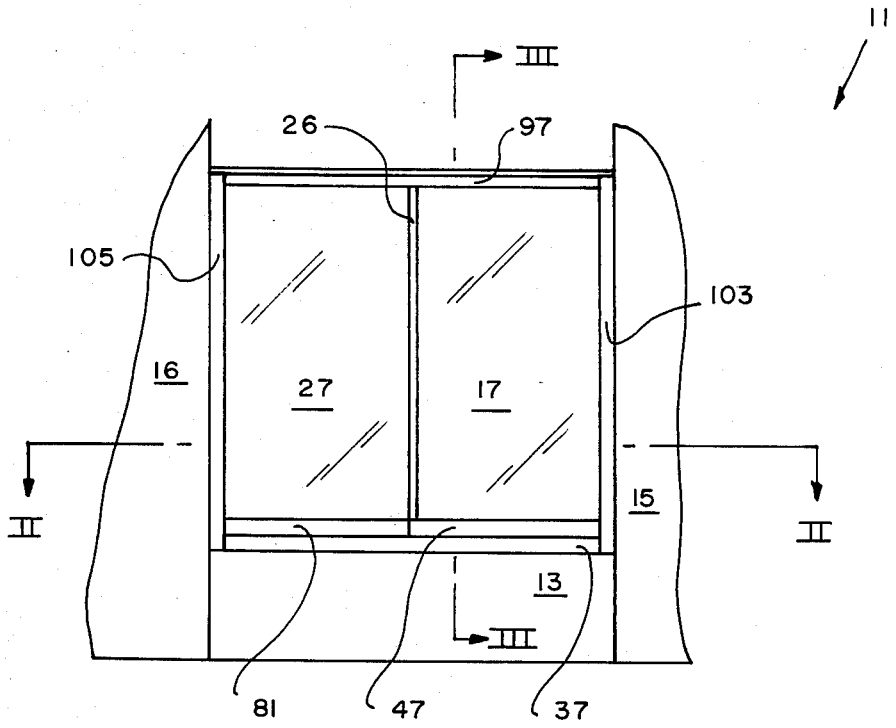
FIG. 1 is a front elevational view of the sliding door assembly of the present invention shown attached to support structure.
Figure 2:
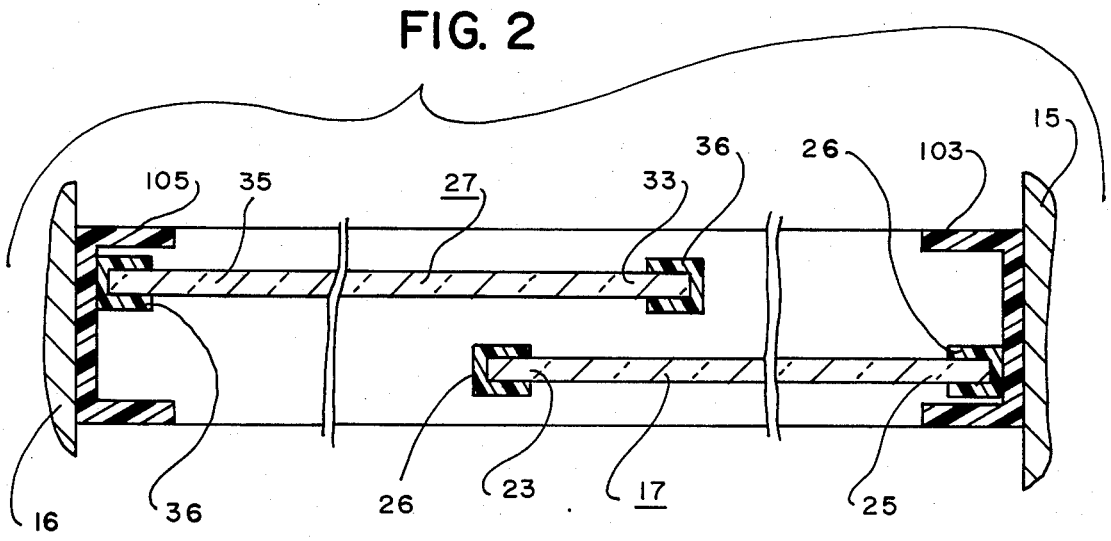
FIG. 2 is an enlarged sectional view of a portion thereof substantially as taken on line II—II of FIG. 1.

The sliding door assembly 11 of the present invention is for being attached to support structure such as the upper ledge of a bathtub 13 and adjacent first and second walls 15, 16. Thus, the assembly 11 may be used to selectively close the access to a bathtub or shower stall as will be apparent to those skilled in the art.

The assembly 11 includes at least a first door panel 17 having at least one substantially horizontal edge. Preferably, the first door panel 17 consists of a substantially rectangular plate or panel of glass, "Plexiglass", or the like having a substantially horizontal upper edge 19, a substantially horizontal lower edge 21, a substantially vertical first side edge 23 and a substantially vertical second side edge 25. Elongated molding 26 having a substantially U-shaped cross-section may be attached to the upper edge 19 and side edges 23, 25. The molding 26 may be extruded or otherwise formed out of plastic such as polyvinyl chloride.

The assembly 11 preferably includes a second door panel 27 that is substantially identical to the first door panel 17 having a substantially horizontal top edge 29, a substantially horizontal bottom edge 31, a substantially vertical first side edge 33 and a substantially vertical second side edge 35 and having elongated molding 36 attached to the top edge 29 and side edges 33, 35.

The assembly 11 includes an elongated support rail member 37 for being attached to the support structure in a substantially horizontal position. When the assembly 11 is used in conjunction with a bathtub 13, the support rail member 37 is preferably fixedly attached to the upper ledge of the bathtub 13 in any manner now apparent to those skilled in the art, such as by way of glue or the like. The support rail member 37 is preferably extruded or otherwise formed out of a plastic such as polyvinyl chloride to have the unique cross-sectional shape as clearly shown in FIG. 3. More specifically, the support rail member 37 preferably has an elongated, substantially horizontal first track portion 39 and an elongated, substantially horizontal second track portion 41 extending the length thereof for reasons which will hereinafter become apparent. Additionally, the support rail member 37 preferably includes an elongated, upwardly directed flange portion 43 extending the length thereof adjacent the first track portion 39 and means for defining an elongated downwardly directed trough portion 45 extending the length thereof adjacent the second track portion 41 for reasons which will hereinafter become apparent.

Figure 13:
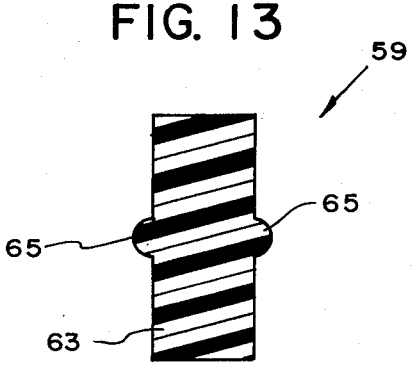
FIG. 13 is a sectional view as taken on line XIII—XIII of FIG. 12.
Figure 12:
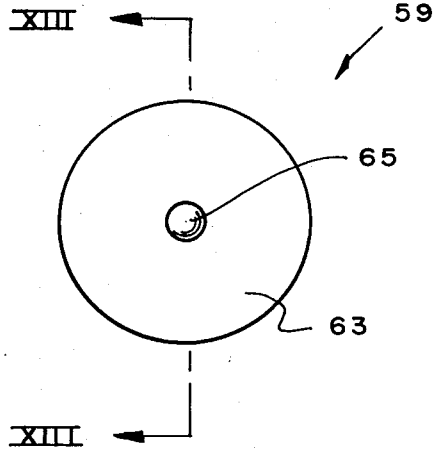
FIG. 12 is a side elevational view of a support roller of the sliding door assembly of the present invention.

The assembly 11 includes at least a first support mount means 47 attached to the first door panel 17 for slidably mounting the first door panel 17 to the support rail member 37 and for allowing the first door panel 17 to move between opened and closed positions. The first support mount means 47 includes an elongated carriage member 49 fixedly attached to a horizontal edge of the first door panel 17. Preferably, the carriage member 49 is fixedly attached to the bottom edge 21 of the first door panel 17. The carriage member 49 is preferably extruded or otherwise formed out of plastic such as polyvinyl chloride to have the unique cross-sectional shape as clearly shown in FIG. 3. More specifically, the carriage means 49 is preferably provided with an upwardly directed, elongated slot 51 for securely receiving the bottom edge 21 of the first door panel 17. The carriage member 49 has a first end 53, a second end 55 and a preferably downwardly directed elongated slot 57 extending between the first and second ends 53, 55. The first support mount means 47 additionally includes a pair of support rollers 59, 61 mounted to the carriage member 49 for engaging the first track portion 39 of the support rail member 37 to thereby rollably support the first door panel 17 on the support rail member 37. The slot 57 in the carriage member 49 receives the support rollers 59, 61. Each support roller 59, 61 is preferably identical to one another and includes a roller body 63 for engaging the support rail member 37 and axle means for engaging the carriage member 49. The axle means may be integral with the roller body 63 and defined merely by spherical-shaped protrusions 65 on either side of the roller body 63 (see, in general, FIG. 13). Thus, the roller body 63 and protrusions 65 may be molded or otherwise formed as a one-piece unit out of plastic such as nylon. The slot 57 in the carriage member 49 has elongated channel means for receiving the protrusions 65 and for allowing the support rollers 59, 61 to move lengthwise along the slot 57 as the first door panel 17 is moved between the opened and closed positions. The channel means preferably consists of a pair of elongated grooves or channels 67, 69 extending lengthwise along either side of the slot 57 for receiving the protrusions 65. The carriage means 49 preferably includes stop or brake means for stopping the lengthwise movement of the support rollers 59, 61 within the slot 57 just prior to the first door panel 17 reaching the closed position to brake the motion of the first door panel 17 as the first door panel 17 is moved to the closed position. The stop means may consist of a block member 73 positioned within the slot 57 substantially midway between the first and second ends 53, 55 of the carriage member 49, a first end member 75 fixedly attached to the first end 53 of the carriage member 49 in a position to block the slot 57 and a second end member 77 fixedly attached to the second end 55 of the carriage member 49 in a position to block the slot 57 for coacting to limit movement of the support rollers 59, 61 within the slot 57. The end members 75, 77 are preferably defined by the lower ends of the moldings 26 attached to the side edges 23, 25 of the first door panel 17. The carriage member 49 preferably includes means for defining a downwardly directed trough portion 79. The trough portion 79 coacts with the flange portion 43 of the support rail member to define alignment means for maintaining the carriage member 49 in proper alignment relative to the support rail member 37 as the first door panel 17 is moved between the opened and closed positions and to hinder or block the passage of water therethrough.

Figure 3:
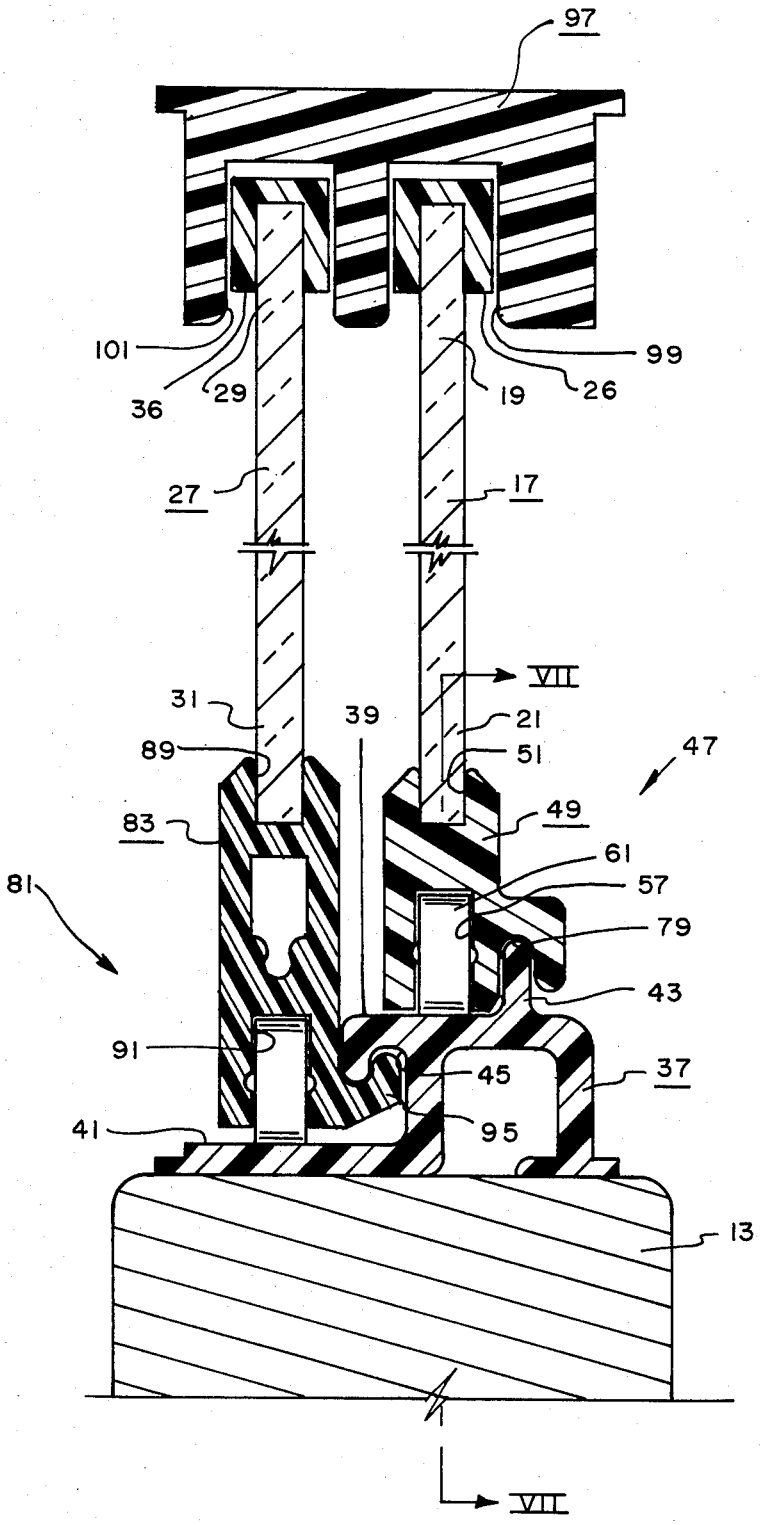
FIG. 3 is an enlarged sectional view of a portion thereof substantially as taken on line III—III of FIG. 1.
Figure 4:
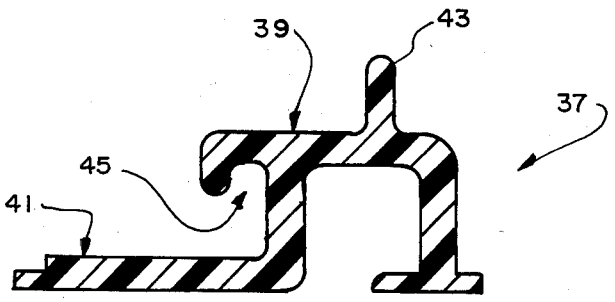
FIG. 4 is a cross-sectional view of a support rail member thereof.
Figure 5:
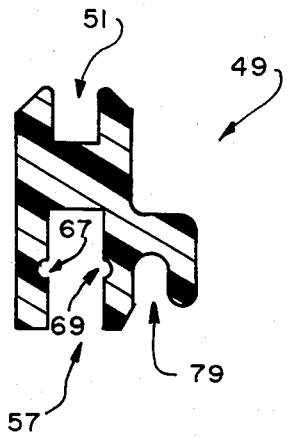
FIG. 5 is a cross-sectional view of a first carriage member thereof.
Figure 6:
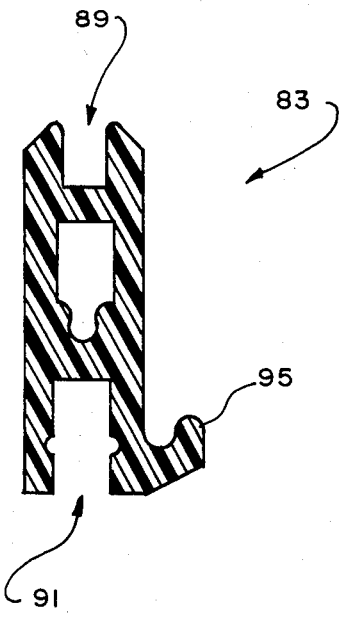
FIG. 6 is a cross-sectional view of a second carriage member thereof.
Figure 7:
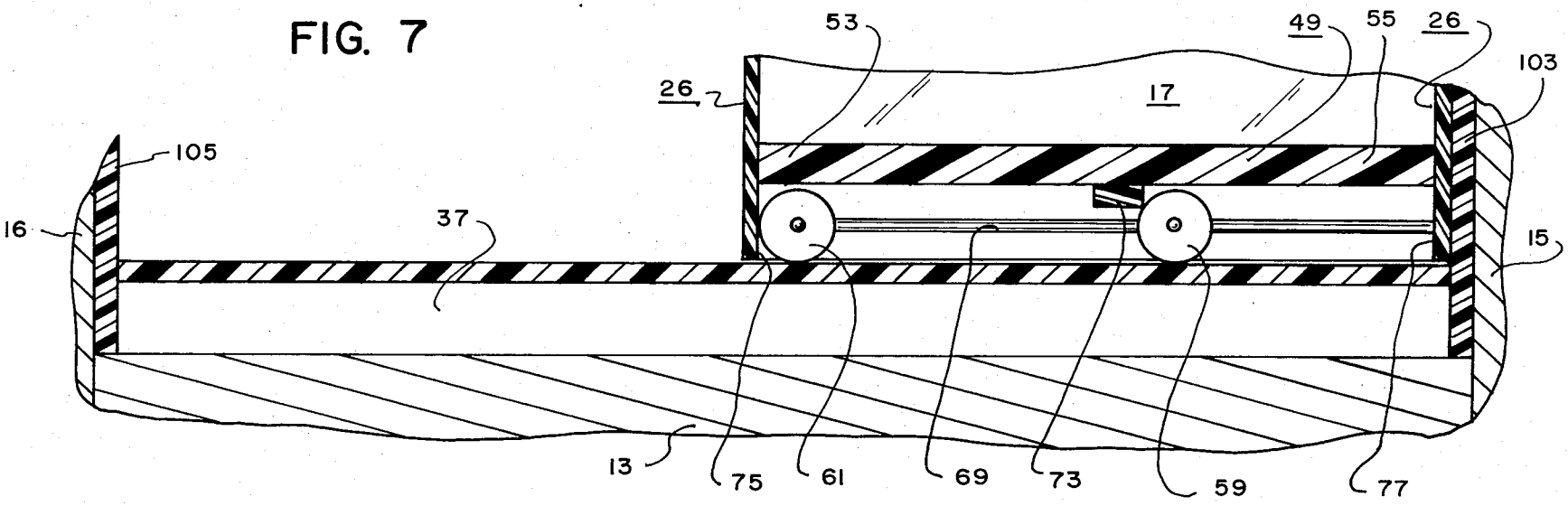
FIG. 7 is a somewhat diagrammatic sectional view of a portion thereof substantially as taken on line VII—VII of FIG. 3 showing a door panel thereof in a first fully closed position.

The assembly 11 may also include a second support mount means 81 attached to the second door panel 27 for slidably mounting the second door panel 27 to the support rail member 37 and for allowing the second door panel 27 to move between opened and closed positions. The second support mount means 81 includes an elongated carriage member 83 fixedly attached to a horizontal edge of the second door panel 27, preferably the bottom edge 31. The second support mount means 81 preferably includes a pair of support rollers mounted to the carriage member 83 and engaging the second track portion 41 of the support rail member 37. The carrier member 83 is preferably extruded or otherwise manufactured out of polyvinyl chloride with the unique cross-sectional shape as clearly shown in FIG. 3. The carriage member 83 is substantially similar to the carriage member 49 and includes an upwardly directed slot 89 for securely receiving the bottom edge 31 of the second door panel 27, a downwardly directed slot 91 including channel means for receiving the support rollers and stop or brake means for limiting the lengthwise movement of the support rollers 85, 87 along the slot 91. The carriage member 83 may be taller than the carriage member 49 as shown in FIG. 3 to provide a uniform appearance when viewed from the outside, etc. The support rollers are substantially identical to the support rollers 59, 61 including a roller body and an axle means. The above description of the first support mount means 47 should be referred to for a more detailed description of the similar components of the second support mount means 81. The carriage member 83 preferably includes means for defining an upwardly directed flange portion 95 for coacting with the trough portion 45 of the support rail member 37 to define alignment means for maintaining the carriage member 83 in proper alignment relative to the support rail member 37 as the second door panel 27 is moved between opened and closed positions and to hinder or block the passage of water therethrough.

The first and second support mount means 47, 81 thus slidably mount the first and second door panels 17, 27 to the support rail member 37 in a side-by-side manner as will now be apparent to those skilled in the art, whereby the open position is defined by the first and second door panels 17, 27 being in an adjacent, coextensive arrangement with one another and the closed position is defined by the first and second door panels 17, 27 being in an extended, offset arrangement with one another as is typical in most sliding, two-panel shower door construction.

Figure 8:
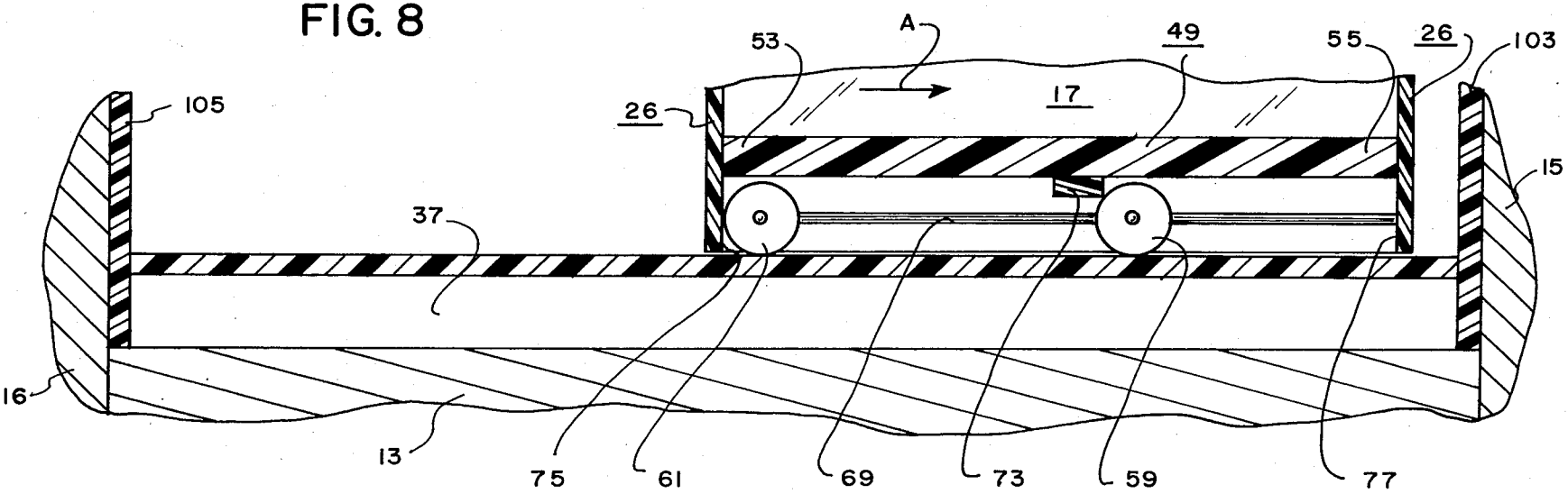
FIGS. 8–11 are substantially similar to FIG. 7 but show the door panel in various positions between the first fully closed position and a second fully closed position.
Figure 9:
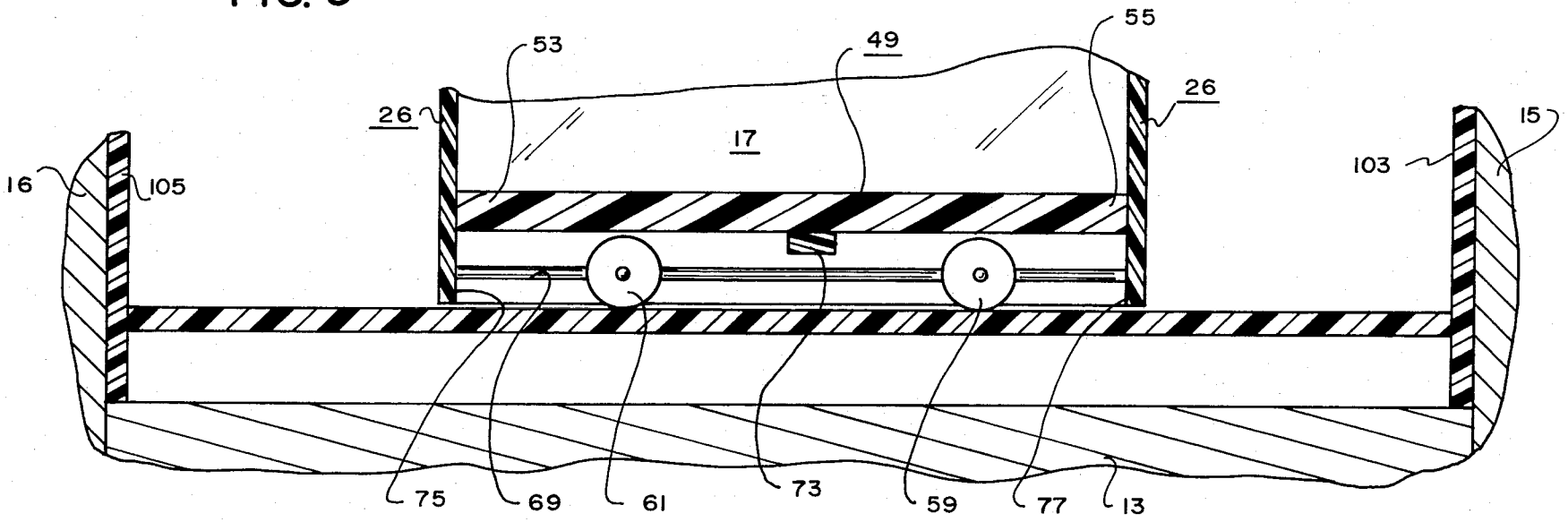
Figure 10:
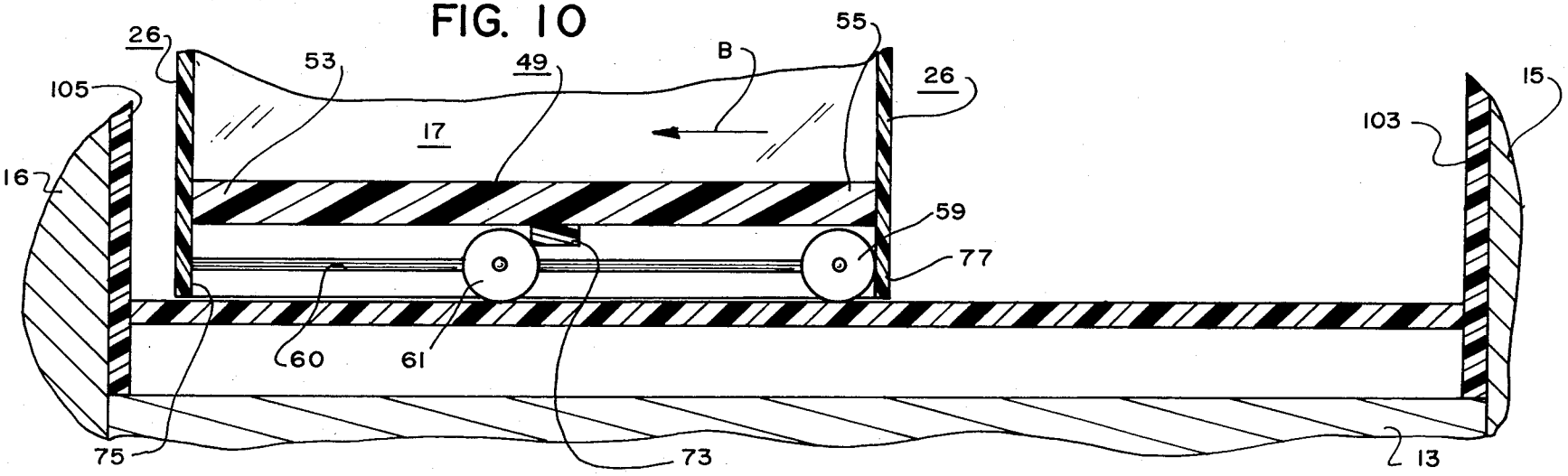
Figure 11:
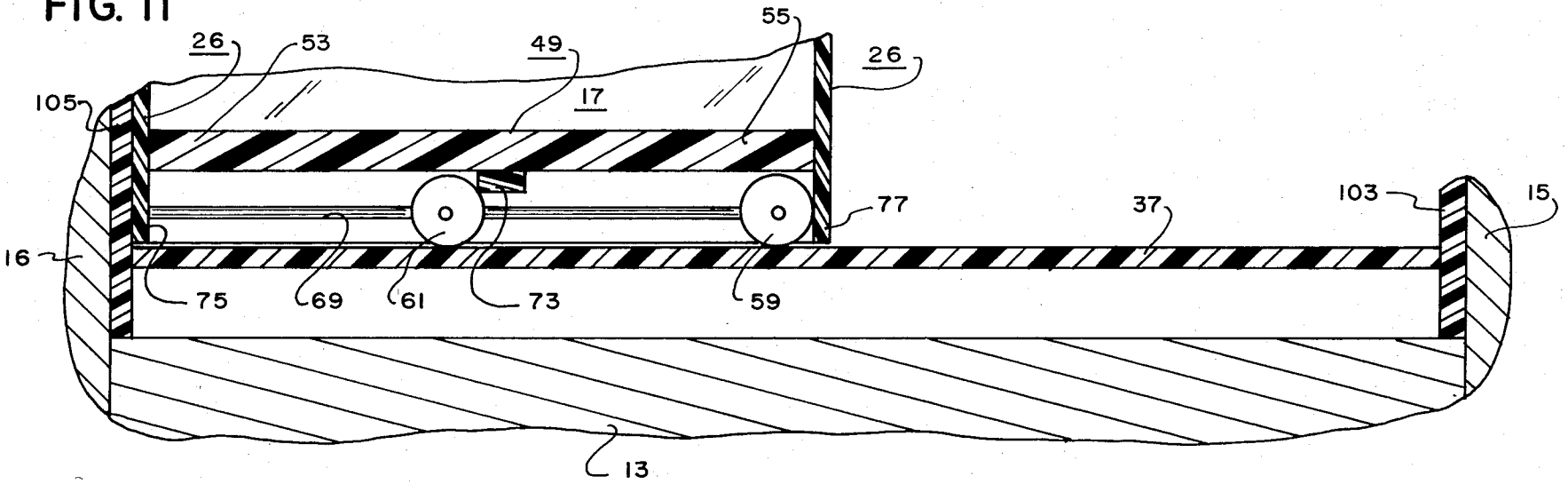

The first door panel 17 is shown in FIGS. 7–11 in various positions between a first fully closed position against the first wall 15 (FIG. 7) and a second fully closed position against the second wall 16 (FIG. 11). The first door panel 17 is shown in FIG. 8 as being moved in the direction of the arrow A toward the first wall 15 with the support roller 59 engaging the block member 63 with the support roller 61 engaging the first end member 75 whereby the movement of the support rollers 59, 61 along the channels 67, 69 is prevented to thus brake the motion of the first door panel 17 as it moves toward the first wall 15 by increasing the friction between the support rail member 37 and first support mount means 47. In FIG. 9, the first door panel 17 is shown substantially intermediate the first and second walls 15, 16 whereby the support rollers 59, 61 are free to rotate on the first track portion 39 and move along the channels 67, 69 without engaging the stop means. In FIG. 10, the first door panel 17 is shown as being moved in the direction of the arrow B toward the second wall 16 with the support roller 59 engaging the second end member 77 and with the support roller 61 engaging the block member 73 whereby the movement of the support rollers 59, 61 along the channels 67, 69 is prevented to thus brake the motion of the first door panel 17 as it moves toward the second wall 16 by increasing the friction between the support rail member 37 and first support mount means 47. The movement characteristics of the second door panel 27 is identical to that described relative to the first door panel 17 and reference should be made to the above description for a more complete understanding. Thus, it will now be appreciated by those skilled in the art that movement of the door panels 17, 27 is free and unhindered when the door panels 17, 27 are spaced from the walls 15, 16 while the unique structure of the assembly 11 coacts to brake the movement of the door panels 17, 27 just prior to the door panels 17, 27 contacting either wall 15, 16 to prevent "slamming" of the door panels 17, 27 against the walls 15, 16, etc.

The assembly 11 preferably includes an upper rail member 97 fixedly attached relative to the support structure (e.g., the walls 15, 16) at a location spaced directly above and parallel to the support rail member 37 for slidably receiving the top edges 19, 29 of the first and second door panels 17, 27. Thus, the upper rail member 97 may be extruded or otherwise manufactured out of polyvinyl chloride with a pair of elongated channels 99, 101 therein for slidably receiving the top edges 19, 29 respectively.

The assembly 11 may also include a pair of end post members 103, 105 for being attached relative to the support structure (e.g., the walls 15, 16) and extending between the support rail member 37 and upper rail member 97 adjacent the opposite ends of the support rail member 37 to engage the second side edges 25, 35 of the first and second door panels 17, 27 respectively when the first and second door panels 17, 27 are in the closed position. The end post members 103, 105 may be extruded or otherwise manufactured out of polyvinyl chloride with a generally U-shaped cross-section.

Although the invention has been described and illustrated with respect to a preferred embodiment thereof and a preferred use therefore, it is not to be so limited since changes and modifications can be made therein which are within the full intended scope of the invention.

I claim:

1. A sliding door assembly for being attached to support structure, said assembly comprising:

(a) a door panel having at least one substantially horizontal edge;

(b) an elongated support rail member attached to said support structure in a substantially horizontal position; and (c) support means attached to said door panel for slidably mounting said door panel to said support rail member and for allowing said door panel to move between open and closed positions, said support mount means including an elongated carriage member fixedly attached to said at least one horizontal edge of said door panel and including a pair of support rollers mounted to said carriage member and engaging said support rail member, said carriage member having a first end and a second end and having an elongated slot therein extending between said first and second ends for receiving said support rollers, each of said support rollers including a roller body for engaging said support rail member and axle means for engaging said carriage member, said slot in said carriage member having elongated channel means for receiving said axle means and for allowing said support rollers to move lengthwise along said slot as said door panel is moved between said opened and closed positions, said carriage member including stop means for stopping the lengthwise movement of said support rollers within said slot just prior to said door panel reaching said closed position to brake the motion of said door panel as said door panel is moved to said closed position.

2. The assembly of claim 1 in which is included alignment means for maintaining said carriage member in proper alignment relative to said support rail member as said door panel is moved between said open and closed positions.

3. The assembly of claim 2 in which said alignment means includes an elongated flange member attached to said support rail member and extending lengthwise thereof, and includes an elongated trough member attached to said carriage member and extending lengthwise thereof for slidably receiving and coacting with said flange member to maintain said carriage member in proper alignment relative to said support rail member as said door panel is moved between said open and closed positions.

4. The assembly of claim 3 in which support rail member has an elongated track portion for supporting said support rollers as said door panel is moved between said open and closed positions.

5. The assembly of claim 4 in which said support rail member and said carriage member are constructed out of plastic.

6. The assembly of claim 5 in which is included a second door panel having at least one substantially horizontal edge, said second door panel being supported by said support rail member; and in which is included a second support mount means attached to said second door panel for slidably mounting said second door panel to said support rail member and for allowing said second door panel to move between open and closed positions, said second support mount means including an elongated second carriage member fixedly attached to said at least one horizontal edge of said second door panel and including a pair of support rollers mounted to said second carriage member and engaging said support rail member, said second carriage member having a first end and a second end and having an elongated slot therein extending between said first and second rollers for receiving said support rollers, each of said support rollers including a roller body for engaging said support rail member and axle means for engaging said second carriage member, said slot in said second carriage member having elongated channel means for receiving said axle means and for allowing said support rollers to move lengthwise along said slot as said door panel is moved between said opened and closed positions, said second carriage member including stop means for stopping the lengthwise movement of said support rollers within said slot just prior to said second door panel reaching said closed position to brake the motion of said second door panel as said second door panel is moved to said closed position.

7. A sliding door assembly for being attached to support structure, said assembly comprising:

(a) a door panel having a substantially horizontal lower edge;

(b) an elongated support rail member attached to said support structure in a substantially horizontal position; and (c) support mount means attached to said door panel for slidably mounting said door panel to said support rail member and for allowing said door panel to move between open and closed positions, said support mount means including an elongated carriage member fixedly attached to said lower edge of said door panel and including a pair of support rollers mounted to said carriage member and engaging said support rail member, said carriage member having a first end and a second end and having an elongated slot therein extending between said first and second ends for receiving said support rollers, each of said support rollers including a roller body for engaging said support rail member and axle means for engaging said carriage member, said slot in said carriage member having elongated channel means for receiving said axle means and for allowing said support rollers to move lengthwise along said slot as said door panel is moved between said opened and closed positions.

8. A sliding door assembly for being attached to support structure, said assembly comprising:

(a) a door panel having at least one substantially horizontal edge;

(b) an elongated support rail member constructed entirely out of plastic attached to said support structure in a substantially horizontal position; and (c) support mount means attached to said door panel for slidably mounting said door panel to said support rail member and for allowing said door panel to move between open and closed positions, said support mount means including an elongated carriage member constructed entirely out of plastic and fixedly attached to said at least one horizontal edge of said door panel and including a pair of support rollers mounted to said carriage member and engaging said support rail member, said carriage member having a first end and a second end and having an elongated slot therein extending between said first and second ends for receiving said support rollers, each of said support rollers including a roller body for engaging said support rail member and axle means for engaging said carriage member, said slot in said carriage member having elongated channel means for receiving said axle means and for allowing said support rollers to move lengthwise along said slot as said door panel is moved between said opended and closed positions.

* * * * *